United States Patent [19]

Fouillout et al.

[11] Patent Number: 4,805,697

[45] Date of Patent: Feb. 21, 1989

[54] METHOD OF PUMPING HYDROCARBONS FROM A MIXTURE OF SAID HYDROCARBONS WITH AN AQUEOUS PHASE AND INSTALLATION FOR THE CARRYING OUT OF THE METHOD

[75] Inventors: Christian Fouillout, Pau; Daniel Sango, Serres Castet, both of France

[73] Assignee: Societe Nationale Elf Aquitaine (Production), France

[21] Appl. No.: 92,172

[22] Filed: Sep. 2, 1987

[30] Foreign Application Priority Data

Sep. 2, 1986 [FR] France ..... 86 12341

[51] Int. Cl.[4] ..... E21B 43/40

[52] U.S. Cl. ..... 166/265; 166/53; 166/306

[58] Field of Search ..... 166/250, 265, 305.1, 166/306, 53, 105, 106; 405/53

[56] References Cited

U.S. PATENT DOCUMENTS

| | | | |
|---|---|---|---|
| 2,808,111 | 10/1957 | Kruger | 166/306 |
| 3,195,633 | 7/1965 | Jacob | 166/306 |
| 3,199,592 | 8/1965 | Jacob | 166/306 |
| 4,009,756 | 3/1977 | Zehren | 166/305.1 X |
| 4,241,787 | 12/1980 | Price | 166/265 X |
| 4,296,810 | 10/1981 | Price | 166/265 |
| 4,429,740 | 2/1984 | Malinchak | 166/53 |

*Primary Examiner*—Bruce M. Kisliuk

*Attorney, Agent, or Firm*—Ostrolenk, Faber, Gerb & Soffen

[57] ABSTRACT

Method and installation for the production of hydrocarbons from a mixture of said hydrocarbons with an aqueous phase by use of a reinjection unit (7), and a separation unit (8) and with regulating the reinjection rate as a function of the content of hydrocarbons (16,15) in the aqueous phase.

16 Claims, 4 Drawing Sheets

METHOD OF PUMPING HYDROCARBONS FROM A MIXTURE OF SAID HYDROCARBONS WITH AN AQUEOUS PHASE AND INSTALLATION FOR THE CARRYING OUT OF THE METHOD

The present invention concerns a method and an installation for the production of hydrocarbons from a mixture of said hydrocarbons with water, by which method this mixture is separated into an aqueous phase containing essentially water in free state, that is to say water that is not in the condition of an emulsion, and a light phase consisting essentially of hydrocarbons, this light phase possibly containing a certain proportion of emulsified water. The invention, therefore, concerns the production of hydrocarbons and the removal of the water possibly present in these hydrocarbons for its reinjection in the vicinity of the producing zone, whether this reinjection is effected above the producing zone or below it.

As a matter of fact, upon the working of oil fields in which the hydrocarbons are mixed with water it is necessary to provide a pump which makes it possible to bring the mixture of hydrocarbons and water to the surface, while in the absence of water, these hydrocarbons might arrive by themselves at the surface under the eruptive effect of the well. Installations and methods have therefore been proposed which make it possible to separate the hydrocarbons from the water and to reinject the water either above or below the producing zone. Reference may be had to U.S. Pat. Nos. 4,241,787 and 4,296,810, which describe a method and installation by which the mixture of water and hydrocarbons is separated with the use of a semi-permeable membrane. Each of the phases is then pumped, the heavy phase being reinjected and the light phase being activated towards the upper end of the well. The installation contemplated by these patents has several drawbacks including the use of a semi-permeable membrane, which is a poorly performing system, particularly in the case of low flow rates, which require membranes of large size.

These installations which employ semi-permeable membranes present clogging problems which make very strict rules of working necessary. Furthermore, the installation contemplated in these U.S. patents is very large. In fact, it comprises an entire series of pipes which connect the separation system to an extraction pump on the one hand and to a reinjection pump on the other hand.

This installation makes it necessary to have production casings of large diameter, and it, therefore, is poorly compatible with the existing production casings. Furthermore, this installation does not permit monitoring of the reinjected aqueous phase; in particular, it does not make it possible to verify that the aqueous phase does not contain hydrocarbons.

One of the main purposes of the invention is to propose a method which permits monitoring of the reinjected aqueous phase in the vicinity of the producing zone. For this, the invention provides a method of pumping hydrocarbons from a mixture of these hydrocarbons with an aqueous phase, said mixture being contained in a producing zone, this method providing a step of separating the mixture into an aqueous phase and a light phase containing essentially hydrocarbons, reinjecting of the aqueous phase into a reinjection zone, said reinjection taking place in accordance with a rate of flow which is regulated as a function of the content of light phase present in the aqueous phase which can be contained within said aqueous phase. A second purpose of the invention is to provide an installation for the carrying out of this method, which is compact and can be easily arranged in existing production wells. This purpose is achieved in the manner that the installation according to the invention is a pumping installation which is located at the lower end of the production well and comprises:

- a means of separating the mixture into an essentially aqueous phase and a light hydrocarbon phase,
- a reinjection means comprising a centrifugal pump for reinjecting the aqueous phase into the reinjection zone at a predetermined rate of flow,
- a regulating means for regulating said rate of flow as a function of the hydrocarbon content of the reinjected aqueous phase.

The reinjection means preferably comprises a valve, the opening of which is controlled by said regulating means. This valve is preferably connected to the pump by a tube in which there is contained a means of monitoring the hydrocarbon content of the aqueous phase.

In accordance with another feature of the invention, the separating means and the centrifugal pump are located in the same cylindrical enclosure and the separating means comprises an aqueous phase recovery chamber which is in direct communication with a suction chamber of the centrifugal pump.

The separating means can consist of a centrifugal separator. That is to say, a separator, which imparts to the mixture a tangential velocity sufficient to permit the separation of the aqueous phase from the light phase. Such a centrifugal separator may be a dynamic centrifugal separator in which the kinetic energy is due to the action of the rotor (or impeller), which is movable in rotation. However, a centrifugal separator can also be a static centrifugal separator in which the kinetic energy imparted to the mixture is due to the passage of the mixture over a static helicoidal deflector under the effect either of the reinjection pump or of the potential of the producing zone. In the case of a dynamic centrifugal separator, the rotor of the separator is driven in rotation by the same means as the means for the rotor of the centrifugal reinjection pump.

According to a special embodiment, the installation comprises a buffer chamber located above the separator and intended to assure additional separation by gravity and to make the treatment rate of the aqueous phase coming from the centrifugal separator uniform. In the buffer chamber, the aqueous phase comes to rest and is thus subjected to a secondary separation by gravity. This chamber is preferably provided with a water-hydrocarbon interface detector which controls the placing of the production string in communication with the upper part of the buffer chamber so as to evacuate the hydrocarbons at the top of the buffer chamber. The length of this chamber is variable and is determined as a function of the nature of the mixture and its rate of flow.

According to a preferred embodiment of the invention, the separator is a dynamic centrifugal separator located above the centrifugal reinjection pump, and it comprises a cylindrical wall co-axial to the said enclosure which defines with it an annular chamber which constitutes the suction chamber of the pump. Such an installation preferably comprises a buffer chamber above the separator. This installation may, if necessary, have a second centrifugal pump which constitutes an activating pump for the light phase. The installation comprises means for the introduction of the mixture of the two phases into the separator.

However, the invention will be better understood from the following description, read with reference to the accompanying drawings, in which.

Figure 1:
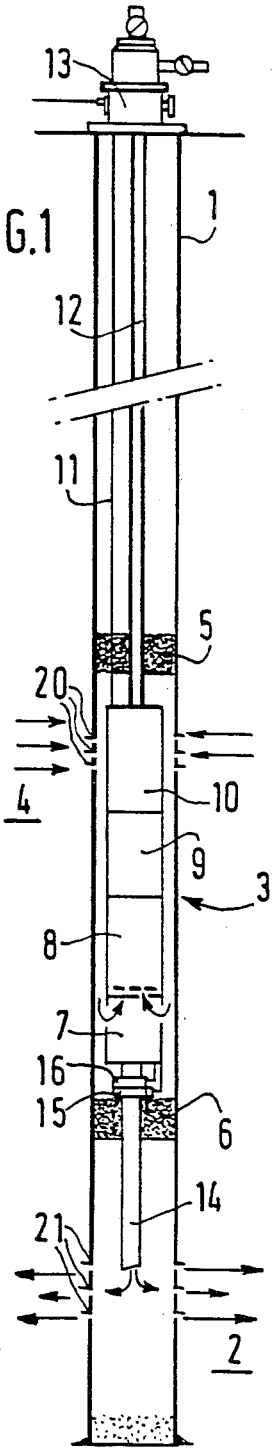
FIG. 1 shows a hydrocarbon production well having an installation in accordance with the invention.

FIG. 1 shows a hydrocarbon production well having an installation in accordance with the invention and permitting the reinjection of the separated water at a level below the level of the producing zone. The production installation comprises a casing 1 which extends from the surface of the ground to the reinjection zone 2. Within the casing 1, the installation 3 of the invention is located at the level of the producing zone 4 between the annular sealing packings 5 and 6 known to those skilled in the art as "packers". It comprises a reinjection pump 7, a separator 8, an activation pump 9, and an electric motor 10 which permits the driving of the activation pump 9, of the rotor of the separator 8, and of the reinjection pump 7. The motor 10 is fed with electricity from the surface by the cable 11; the installation 3 is connected to the surface by the production tube 12 which are firmly attached to the wellhead 13. The reinjection pump 7 debouches towards the reinjection zone 2 via a reinjection tube 14, the regulated valve 15 and detectors 16. The well casing 1 is provided at the level of the producing zone 4 with entrance orifices such as 20 and at the level of the reinjection zone 2 with reinjection orifices such as 21.

Figure 2:
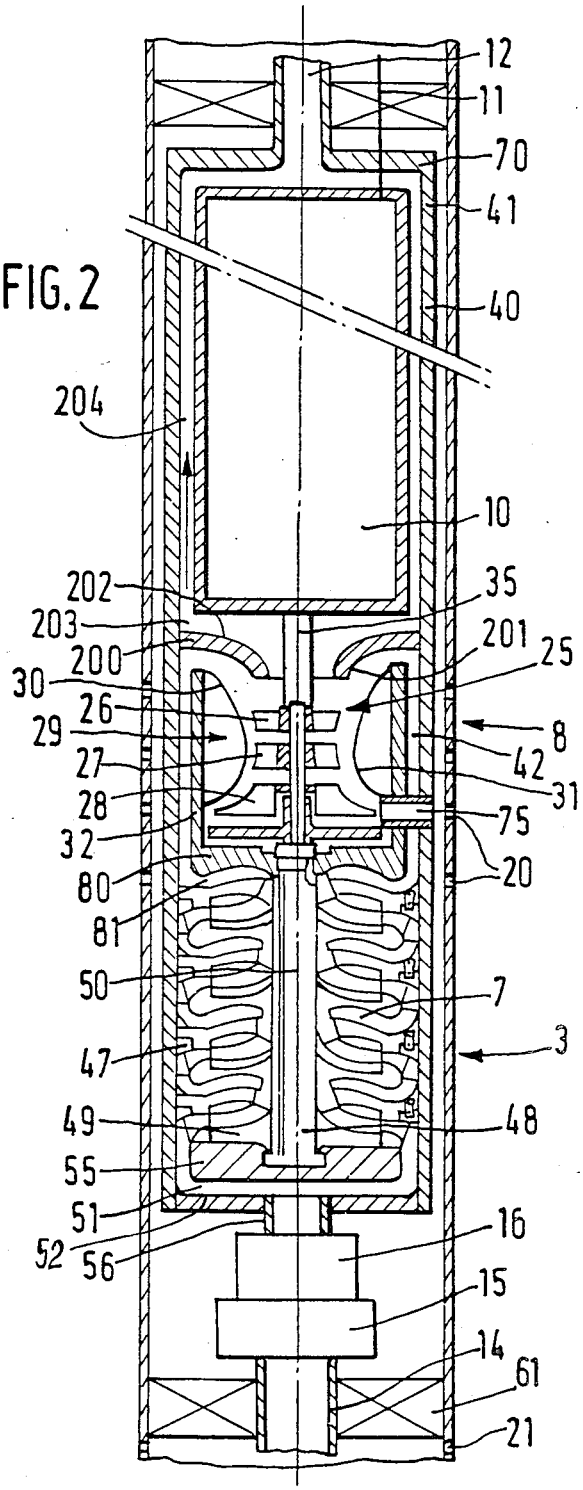
FIG. 2 shows an installation according to the invention which is intended for an eruptive well.

FIG. 2 shows a detail view of an installation 3 intended for an eruptive well. The separator 8 has a helicoidal impeller 25 with three stages 26, 27, 28 and a stator 29 formed of a divergent part 30, a convergent part 31 and the circular wall 32. The helicoidal impeller is driven in rotation by the electric motor 10 via the transmission shaft 35.

The circular wall 40 of the enclosure 41 defines, with the circular wall 32 of the separator 8, an annular chamber 40 the role of which will be defined further below.

In its upper portion, the separator 8 comprises a deflector wall 200, which has an entrance zone 201 which is circular and surrounds the transmission shaft 35. The entrance zone 201 is connected to the enclosure 41 by a convergent wall 202 which defines a passage 203. This passage debouches into the annular space 204 defined by the wall of the motor 10 and the wall 40 of the enclosure 41.

Within the enclosure 41 and below the separator there is the reinjection pump 7. It comprises a multistage stator 47 and a motor 48 formed of vanes 49 firmly attached to the central hub 50, in its turn firmly attached to the rotation shaft 35. The pump 7 debouches into the chamber 51 defined by the lower wall 52 of the enclosure 41, by the cylindrical wall 40 and by the disc 55 constituting the lower end of the rotor of the pump. This chamber 51 is provided at its center with a tube 56 for the reinjection of the water, said tube, in its turn, being connected to the regulated valve 15, upstream of which the devices 16 for detecting the quality of the water are located. The valve 15 debouches into the chamber 51 via the tube 14. The chamber 51 is provided with perforations 21 for the reinjection. In its upper part, the enclosure 41 is closed by the wall 70 and debouches into the production tube 12. The electric motor 10 is located in the enclosure 41 at its upper part and is connected to its feed cable 11. At the level of the producing zone 4, the casing 1 has entrance perforations 20 which debouch into the annular space defined between the casing 1 and the enclosure 41. This enclosure 41 is provided at this production level with a tube 75 which places the annular space defined by the casing and the enclosure, on the one hand, in communication with the lower part of the separator 8, on the other hand, which part corresponds to the first stage of the impeller.

One and the same base 80 defines the lower part of the separator 8 and the upper part of the pump 7. This base also defines a communication zone 81 which places the annular zone 42 and the first suction stage of the pump in communication.

The installation shown operates in the following manner.

The mixture of hydrocarbons and water, which is located in the producing zone 3, penetrates, via the perforations 20, into the casing 1 and fills up the entire space defined by the packers 6 and 5. Via the tube 75, this mixture is introduced into the lower part of the separator 8 the rotor of which is driven by the motor 10; the mixture is therefore propelled towards the upper portion of the separator. The heavy phase, under the centrifugal effect of the impeller 8, is recovered on the periphery of the separator and against the wall 32 and flows down in the annular zone (42). The light phase, formed of the hydrocarbons, rises towards tube 12, under the eruptive effect of the production field, penetrating first of all into the entrance zone 201 and the passage 203.

The heavy part, that is to say the water, is drawn by the pump 7 into the chamber 81 and is delivered via the tube 56 towards the regulated valve 15 and the reinjection perforations 21.

The group of detectors 16 detects the possible presence of hydrocarbons in the water. As a function of this presence and of the quantity of hydrocarbons, the unit 16 controls the closing of the valve 15 so as to decrease the rate of flow of water to be reinjected and therefore increase the time of separation in the separator 8.

Figure 3:
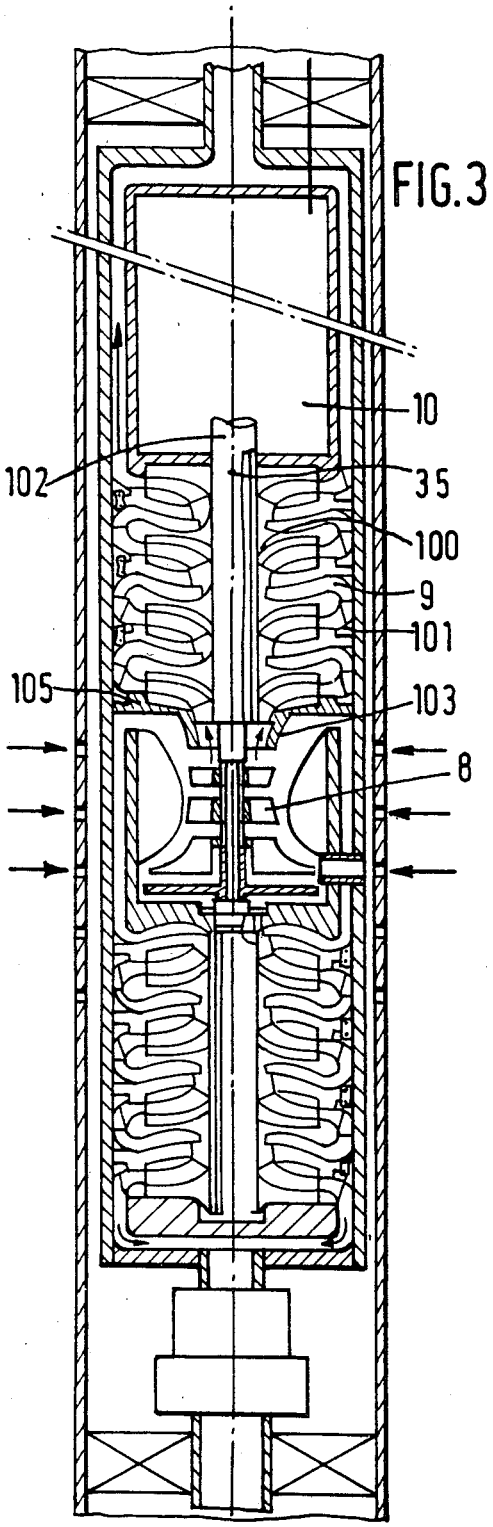
FIG. 3 shows an installation similar to that of FIG. 2, but intended for a non-eruptive well.

FIG. 3 shows an installation similar to that of FIG. 2 but intended for a non-eruptive well, it therefore having an activating pump 9. This pump comprises a rotor 100 and a stator 101 both of which have several stages. The rotor 100 is integral with a central hub 102 driven in rotation by the rotation shaft 35 of the motor 10. The pump 9 draws the hydrocarbons into the upper and central part of the separator 8 via the aspiration spout 103 which is integral with the base 105 constituting the lower part of the pump.

The device shown in FIG. 3 operates in the same manner as the one shown in FIG. 2.

Figure 4:
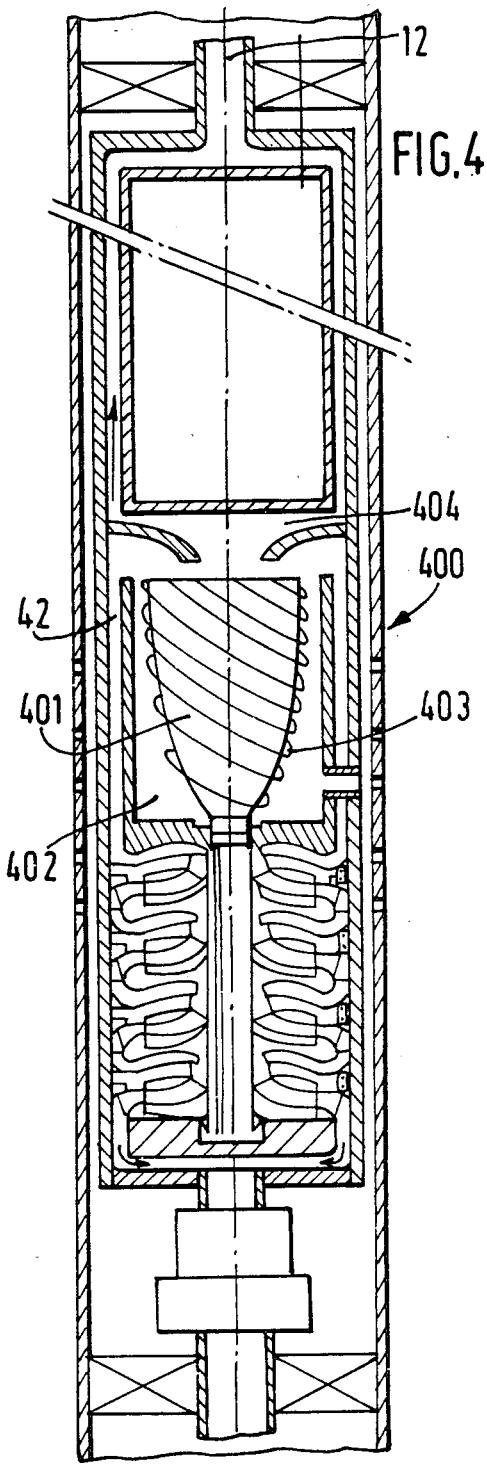
FIG. 4 shows an installation according to the invention, provided with a static separator.

FIG. 4 shows a variant embodiment of the invention in accordance with which the separator 8 is a static centrifugal separator. The parts common to the previous figures bear the same reference numbers.

The static separator 400 has a central hub 401 having substantially the shape of an ogive, the pointed end of which is located towards the bottom of the enclosure 402 in which it is located, said ogive having a helicoidal thread 403. This unit is very well-known to the man skilled in the art by the name of static centrifugal separator. In operation, the mixture to be separated is introduced towards the bottom of the separator and, under the effect either of the eruptive potential of the well or of the suction created by the reinjection pump, this mixture is placed in rotation by the fins. In the upper part, the hydrocarbons penetrate into the passage 404, into the annular chamber and then into the production tubing 12. The aqueous phase, which constitutes the heavy phase, is evacuated by the annular chamber 42 and then drawn in by the pump 7.

Figure 5:
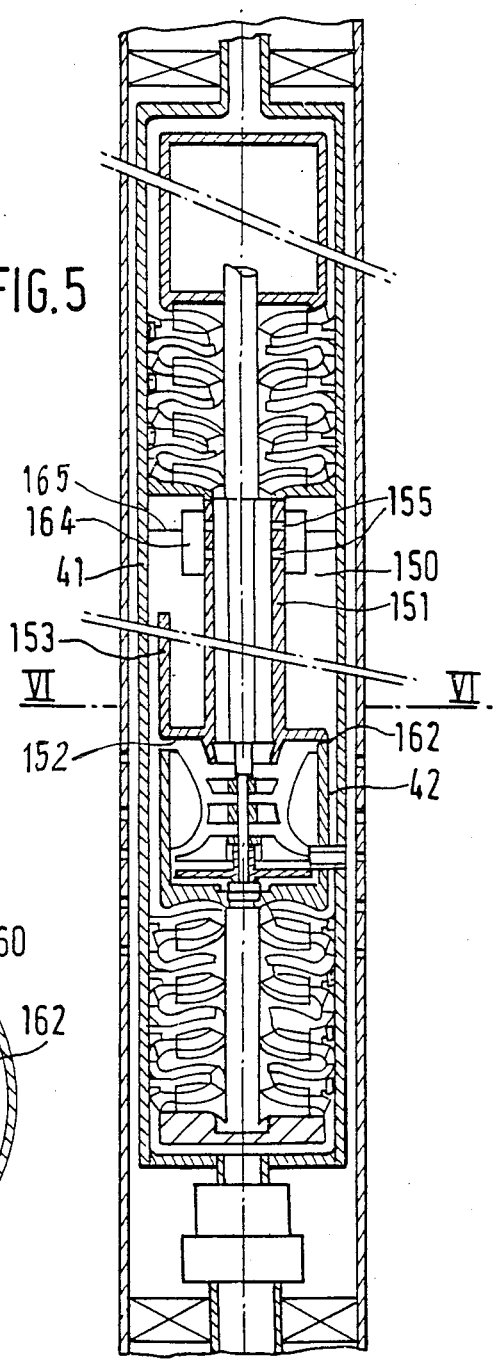
FIG. 5 shows another variant of the invention in accordance with which the installation has a static separator.
Figure 6:
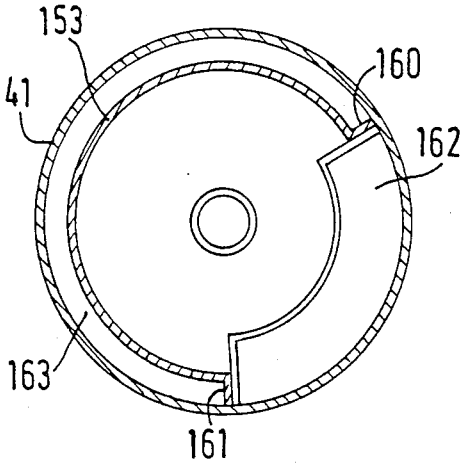
FIG. 6 is a section along the axis VI—VI of FIG. 5.

In FIGS. 5 and 6, the installation in accordance with the invention comprises, between the activation pump and the dynamic separator a static separator 150 comprising a central cylindrical wall 151 provided with orifices 155, a lower wall 152 and a lateral cylindrical wall 153.

A cylindrical sleeve 164 surrounds the central cylindrical wall 151 at the level of the orifices 155. The position of the cylindrical sleeve 164 on the cylindrical wall 151 is determined by the level of the interface 165 between the hydrocarbon and the water. In the lower part of the separator, the lateral cylindrical wall 153 and the wall 41 of the enclosure 40 define a crown portion closed at its ends by the two flat side walls 160 and 161. The lower wall 152 is provided with an opening 162 which has the shape of a crown sector the angle of which is complementary to that of the crown 163. This opening 162 debouches into the upper part of the annular space 42. The circular wall 32 is firmly attached to the bottom 170 of the separator at an angle identical to that of the chamber 162. Outside of this sector, it is spaced from the bottom by a distance 171. The annular chamber 163 defined by the walls 153, 41, 160, and 161 debouches in its lower part into the same annular chamber 42. Such a static separator permits better separation of the water and the oil and due to the presence of the mobile sleeve 164 which can block orifices 155 when the separator is filled with water, the static separator can take into account the variations in the position of the water/oil interface and accordingly take into account the variations in rate of flow of the valve 15.

Figure 7:
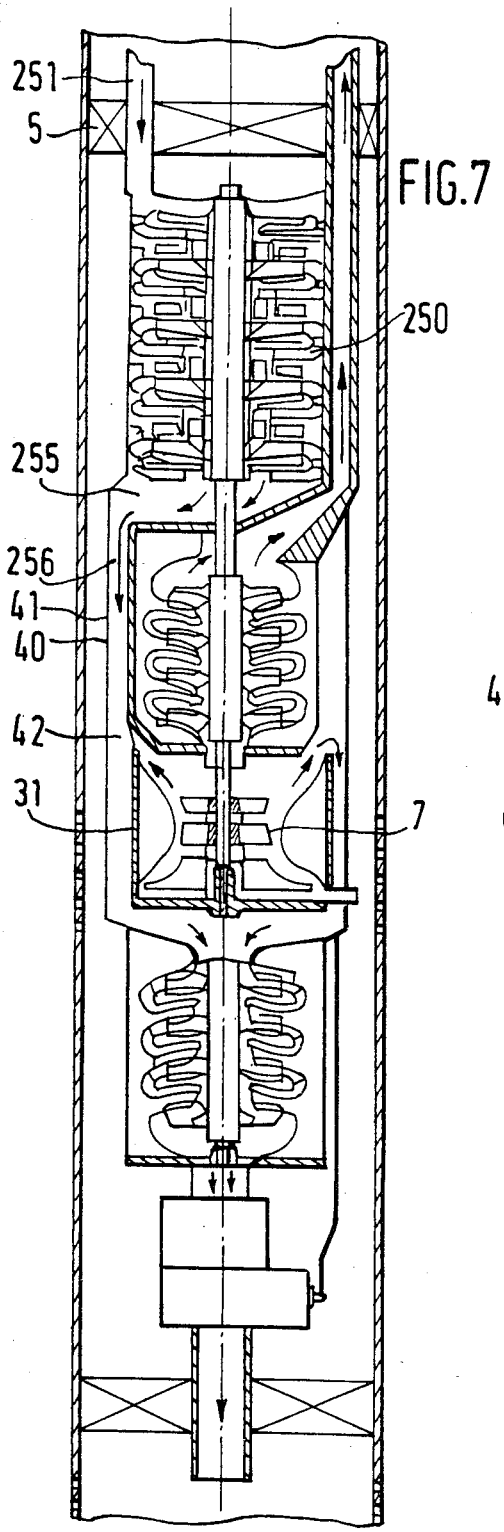
FIG. 7 is a view of an installation according to the invention the driving power of which is obtained from a hydraulic motor

FIG. 7 shows an installation according to the invention in which the drive motor is a hydraulic motor, driven by a drive fluid consisting of water which is recovered at the outlet of the motor and then mixed with the aqueous phase before its reinjection into the producing zone. In this figure, the parts common to the preceding figures bear the same reference numbers.

The motor 250 is a conventional hydraulic motor having a stator and a rotor, the said rotor being placed in rotation by a drive fluid arriving at the upper part through the channel 251. In the lower part of the motor 250, the fluid is collected in a casing 255 connected to an annular chamber 256 which debouches in the lower part in the annular chamber 42 defined by the wall 41 of the enclosure 40 and by the annular wall 31 of the separator 7. In accordance with this embodiment, the water controlling the placing in rotation of the hydraulic motor is therefore recovered and mixed with the water coming from the dynamic centrifugal separator.

Figure 8:
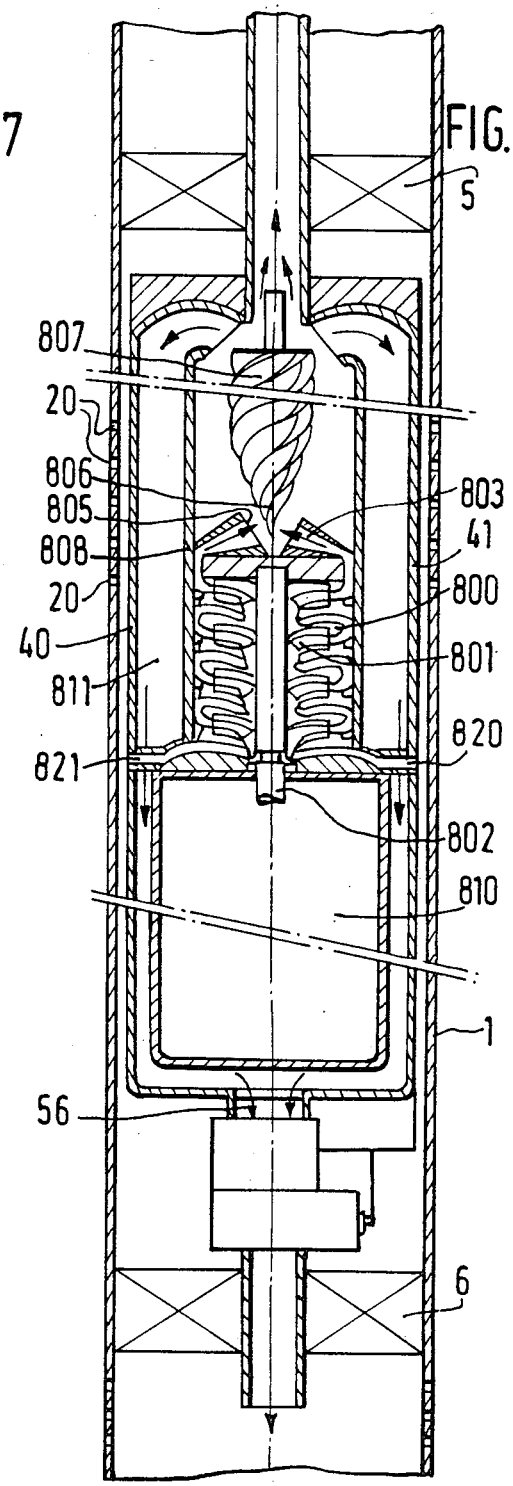
FIG. 8 shows another embodiment according to the invention.

FIG. 8 shows an embodiment of the invention in accordance with which the reinjection means for the aqueous phase comprises a centrifugal pump which places the mixture to be separated in rotation and sends it to a static centrifugal separator.

The parts common to this figure and the preceding figures bear the same reference numbers.

The installation is placed within the enclosure 41 located between the two packers 5 and 6. It comprises the electric motor 810 connected to the rotor 801 of the pump 800 by the shaft 802. The delivery chamber 803 of the pump 800 is frustoconical and has a central opening 805 located opposite the end 806 of the static separator 807. The pump 800 and the separator 807 are placed in a cylindrical enclosure 808 which, together with the wall 40 of the enclosure 41, defines the annular chamber 811 which is connected in its lower part to the tube 56. At the lower part of the pump 800, the enclosure 41 is provided with four tubes such as 821 which place the inside of the production tubing 1 and suction chamber of the pump 800 in communication.

In operation, the mixture of water and hydrocarbons penetrates into the casing 1 through the orifices 20 and fills the entire space between the packers 5 and 6. Through the tubes 820 and 821, the mixture penetrates into the aspiration chamber of the pump 800 and it is delivered and projected onto the separator 807 in a circular movement. At the upper part of the separator, the hydrocarbons are recovered by the production casing while the aqueous phase is recovered in the annular chamber 811 and then sent beyond the packer 6 through the tube 56.

However, the invention described with reference to the preceding figures is in no way limited to these embodiments. In particular, for each installation shown one can provide either a dynamic centrifugal separator or a static centrifugal separator and either of these separators can be associated with a buffer zone.

With respect to the buffer zone, one can provide any device for the detection of the water-hydrocarbon interface level, whether such devices are mechanical devices such as those shown or are electrical or other interface detection devices.

Finally, the invention permits production from a producing zone in which the mixture of hydrocarbons and water also contains a gaseous portion. Under these conditions, the gaseous portion remains mixed with the hydrocarbons and is separated out on the surface.

We claim:

1. A method of pumping hydrocarbons from a mixture of said hydrocarbons with an aqueous phase, said mixture being contained within a producing zone, the method comprising a stage of separating the mixture into an aqueous phase and a light phase containing essentially hydrocarbons and reinjecting said aqueous phase into a reinjection zone, characterized by the fact that said reinjecting rate of flow is regulated as a function of the hydrocarbon content in the reinjected aqueous phase.

2. A pumping installation for the production of hydrocarbons from a mixture of said hydrocarbons with an aqueous phase, located at the lower end of a production well, and comprising a means of separating the mixture into an aqueous phase and a light phase containing essentially hydrocarbons, a reinjection means comprising a centrifugal pump in order to reinject the aqueous phase into a reinjection zone, characterized by the fact that said installation comprises a regulating means for regulating the reinjection rate as a function of the hydrocarbon content in the reinjected aqueous phase of.

3. An installation according to claim 2, characterized by the fact that the reinjection means comprises a valve the opening of which is controlled by the said regulating means.

4. An installation according to claim 3, characterized by the fact that the valve is connected to the reinjecting means by a tube, the said tube comprising a means for monitoring the hydrocarbon content of the aqueous phase.

5. An installation according to claim 2, characterized by the fact that the separating means and the centrifugal pump are located in a common cylindrical enclosure, the separating means comprising a recovery chamber for the aqueous phase which is in direct communication with a suction chamber of the centrifugal pump.

6. An installation according to claim 2, characterized by the fact that the means for separating is a centrifugal separator.

7. An installation according to claim 2, characterized by the fact that the means for separating is a gravity separator.

8. An installation according to claim 6, characterized by the fact that the centrifugal separator is a dynamic centrifugal separator.

9. An installation according to claim 6, characterized by the fact that the centrifugal separator is a static centrifugal separator.

10. An installation according to claim 8, in which the dynamic centrifugal separator and centrifugal reinjection pump each have a rotor driven by a means for driving, characterized by the fact that said rotor of the separator is driven in rotation by the same means for driving in rotation as the rotor of the centrifugal reinjection pump.

11. An installation according to claim 2 in which the means of separating is a centrifugal separator located above the centrifugal reinjection pump, characterized by the fact that the said separator has a cylindrical wall co-axial to a side wall of an enclosure in which the installation is located, said separator and said wall of said enclosure defining an annular chamber constituting the suction chamber of the centrifugal reinjection pump.

12. An installation according to claim 6, characterized by the fact that above the centrifugal separator is a buffer chamber formed of a gravity separator.

13. An installation according to claim 12, characterized by the fact that the said buffer chamber comprises a central cylindrical wall defining a cylindrical chamber the upper end of which is provided with orifices which permit the passage of the hydrocarbons therethrough.

14. An installation according to claim 2, characterized by the fact that the installation comprises, furthermore, a centrifugal activation pump for withdrawing hydrocarbons from the means of separating.

15. An installation according to claim 11, characterized by the fact that the installation comprises a centrifugal activation pump for withdrawing hydrocarbons from the means of separating the inside of the annular chamber defined by the central wall communicates with the suction stage of the said activation pump.

16. An installation according to claim 9, characterized by the fact that the reinjection means comprises a centrifugal pump which places the mixture to be separated in rotation and sends it to the static centrifugal separator.

* * * * *